US008739594B2

(12) United States Patent
Anderson

(10) Patent No.: US 8,739,594 B2
(45) Date of Patent: Jun. 3, 2014

(54) ELECTRICAL CONNECTOR CRIMPING PLIER TOOL

(76) Inventor: Danny Anderson, Bradenton, FL (US)

( * ) Notice: Subject to any disclaimer, the term of this patent is extended or adjusted under 35 U.S.C. 154(b) by 0 days.

(21) Appl. No.: 13/617,006

(22) Filed: Sep. 14, 2012

(65) Prior Publication Data

US 2013/0067983 A1 Mar. 21, 2013

Related U.S. Application Data

(60) Provisional application No. 61/534,936, filed on Sep. 15, 2011.

(51) Int. Cl.

| | |
|---|---|
| ***B21D 37/10*** | (2006.01) |
| ***B21F 1/00*** | (2006.01) |
| ***H01R 43/033*** | (2006.01) |
| ***B25B 7/14*** | (2006.01) |

(52) U.S. Cl.
USPC ..... 72/409.01; 72/409.13; 81/424.5; 81/426; 140/106

(58) Field of Classification Search
USPC ..... 81/315, 424.5, 426; 140/106; 72/409.01, 409.13
See application file for complete search history.

(56) References Cited

U.S. PATENT DOCUMENTS

| | | | | |
|---|---|---|---|---|
| 404,811 | A * | 6/1889 | Wichelhaus | 81/426 |
| 511,091 | A * | 12/1893 | Neuhaus | 81/426 |
| 1,619,084 | A * | 3/1927 | Miller | 140/106 |
| 1,666,801 | A * | 4/1928 | Varney | 140/106 |
| 2,700,910 | A * | 2/1955 | Van Niel | 81/426 |
| 2,755,692 | A * | 7/1956 | Wallshein | 140/106 |
| 2,763,171 | A * | 9/1956 | Modrey et al. | 72/409.01 |
| 3,487,524 | A | 1/1970 | Filia | |
| 4,199,972 | A | 4/1980 | Wiener | |
| 4,353,240 | A | 10/1982 | Undin et al. | |
| 4,693,246 | A * | 9/1987 | Reimels | 81/424.5 |
| 6,151,950 | A | 11/2000 | Wilhelm et al. | |
| 6,832,532 | B2 * | 12/2004 | Kilpela et al. | 81/315 |
| 7,552,748 | B2 | 6/2009 | Dean | |

FOREIGN PATENT DOCUMENTS

| | | |
|---|---|---|
| EP | 2179820 | 4/2010 |

* cited by examiner

*Primary Examiner* — David B Jones
(74) *Attorney, Agent, or Firm* — Maxey Law Offices PLLC; Stephen Lewellyn

(57) ABSTRACT

A plier tool for crimping electrical connectors to wires includes two plier handles that are pivotally connected together by a pivotal coupling that allows for rotation of the handles, towards and away from one another. The two plier handles each have gripping portions that are graspable by a user to rotate the plier handles about the axis of rotation. A crimping die is located on each plier handle, at an end opposite of the gripping portion thereof, and rotation of the plier handles causes the crimping dies to be moved towards and away from one another between engaging and non-engaging positions. The crimping die, together, define an opening that is configured to receive an electrical connector in a manner that positions the electrical connector in an endwise direction that is generally perpendicular to the axis of rotation.

6 Claims, 2 Drawing Sheets

ELECTRICAL CONNECTOR CRIMPING PLIER TOOL

FIELD OF THE INVENTION

The present invention relates plier tool, and more particularly, relating to an electrical connector crimping plier tool permitting the crimping of electrical connectors to ends of the electrical leads in tight spaces.

BACKGROUND OF THE INVENTION

Hand-operated plier tools have been used for crimping electrical connectors to ends of electrical leads. These various plier tools often include a pair of cooperating jaws that may be either fixed or interchangeable. The cooperating jaws are mounted to the ends of cooperating handles.

The cooperating handles are capable of moving, relative to each other, in either an open or a closed configuration. More specifically, in the open configuration, the handles are moved relative to each other in such a way that the cooperating jaws are separated from one another. Likewise, in the closed configuration, the handles are moved relative to each other in such a way that the cooperating jaws are brought together, such that the jaws are closed about any objects, such as electrical connectors, that may be placed between the cooperating jaws.

It is known to provide similar hand-operated plier tools that require electrical connectors to be positioned in a direction across the tool such that the electrical connector is parallel to the pivot axis of the cooperating interconnecting handles of the tool.

The use of such hand-operated plier tools is made difficult in confined spaces. For example, electrical leads located in engine compartments and instrument panels of vehicles are typically disposed within narrow spaces between adjacent structures and, in such cases, the electrical leads are often too short to extend outwardly from the narrow space, making access to the electrical connector difficult, and the crimping of the electrical connector even more frustrating. The inaccessibility of the electrical leads may cause the user numerous failed attempts to crimp the electrical connector to the electrical lead, ultimately resulting in tossed electrical connectors.

Accordingly, there is a need for an improved electrical connector crimping tool that is particularly useful in crimping electrical connectors to ends of the electrical leads in tight and confined spaces.

SUMMARY OF THE INVENTION

The preferred embodiments of the present invention addresses this need by providing a plier tool for crimping electrical connectors to wires that is particularly useful in crimping electrical connectors to ends of the electrical leads in tight and confined spaces.

The preferred embodiments of the present invention also provide a plier tool that may simply be inserted straight into a narrow space to position an electrical connector between two crimping dies in an endwise direction, rather than in a sideways direction.

The preferred embodiments of the present invention further provide a plier tool that may be used to hold an electrical connector for positioning on an electrical lead as a result of the plier tool's specific configuration of the two crimping dies.

To achieve these and other advantages, in general, in one aspect, a plier tool for crimping electrical connectors to wires is provided. The plier tool includes first and second plier handles that are pivotally connected together by a pivotal coupling. The pivotal coupling allows for rotation of the first and second plier handles, towards and away from one another, about an axis of rotation extending through the pivotal coupling and generally perpendicular to the first and the second plier handles. The first and second plier handles each have gripping portions that are graspable by a user to rotate the first and the second plier handles about the axis of rotation. A male crimping die is located on the first plier handle at an end opposite of the gripping portion thereof. Likewise, a female crimping die is located on the second plier handle at an end opposite of the gripping portion thereof, wherein rotation of the first and the second plier handles cause the male crimping die and the female crimping die to be moved towards and away from one another between engaging and non-engaging positions. The male crimping die and the female crimping die, together, define an opening configured to receive an electrical connector therein in an orientation that positions an electrical connector in an endwise direction that is generally perpendicular to said axis of rotation.

In general, in another aspect, a plier tool for crimping electrical connectors to wires is provided. The male crimping die includes a leg portion that has a concaved end that is configured to cradle the side of an electrical connector while the female crimping die is generally U-shaped and includes a projection extending from a wall opposite of the male crimping die's concaved end.

In general, in another aspect, a plier tool for crimping electrical connectors to wires is provided. The concaved end of the male crimping die and the U-shaped end of the female crimping die, including the projection, are oppositely disposed along a center line. The concaved end of the male crimping die further serves to align the electrical connector along the center line.

In general, in another aspect, a plier tool for crimping electrical connectors to wires is provided. The female crimping die generally includes two side wall portions and an upper wall portion that define the U-shape of the female die and wherein the projection is disposed on the upper wall portion of the female crimping die.

In general, in another aspect, a plier tool for crimping electrical connectors to wires is provided. The projection of the female die tapers from wide to narrow in a direction from the upper wall portion towards the terminal end thereof in the generally U-shaped inwardly opening space.

In general, in another aspect, a plier tool for crimping electrical connectors to wires is provided. The gripping portions of the first and second plier handles are covered by a cushion material to provide comfort to the hands of the user during use.

In general, in another aspect, a plier tool for crimping electrical connectors to wires is provided. The cushion material cover the gripping portions of the first and second plier handles may also include an anti-slip material to prevent the first and second plier handles from slipping from the user's hands during use.

There has thus been outlined, rather broadly, the more important features of the invention in order that the detailed description thereof that follows may be better understood and in order that the present contribution to the art may be better appreciated.

Numerous objects, features, and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

As a preliminary matter, it should be noted that in this document (including the claims) directional terms, such as "above", "below", "upper", "lower", etc., are used for convenience in referring to the accompanying drawings. Additionally, it is to be understood that the various embodiments of the invention described herein may be utilized in various orientations, such as inclined, inverted, horizontal, vertical, etc., without departing from the principles of the invention.

Figure 1:
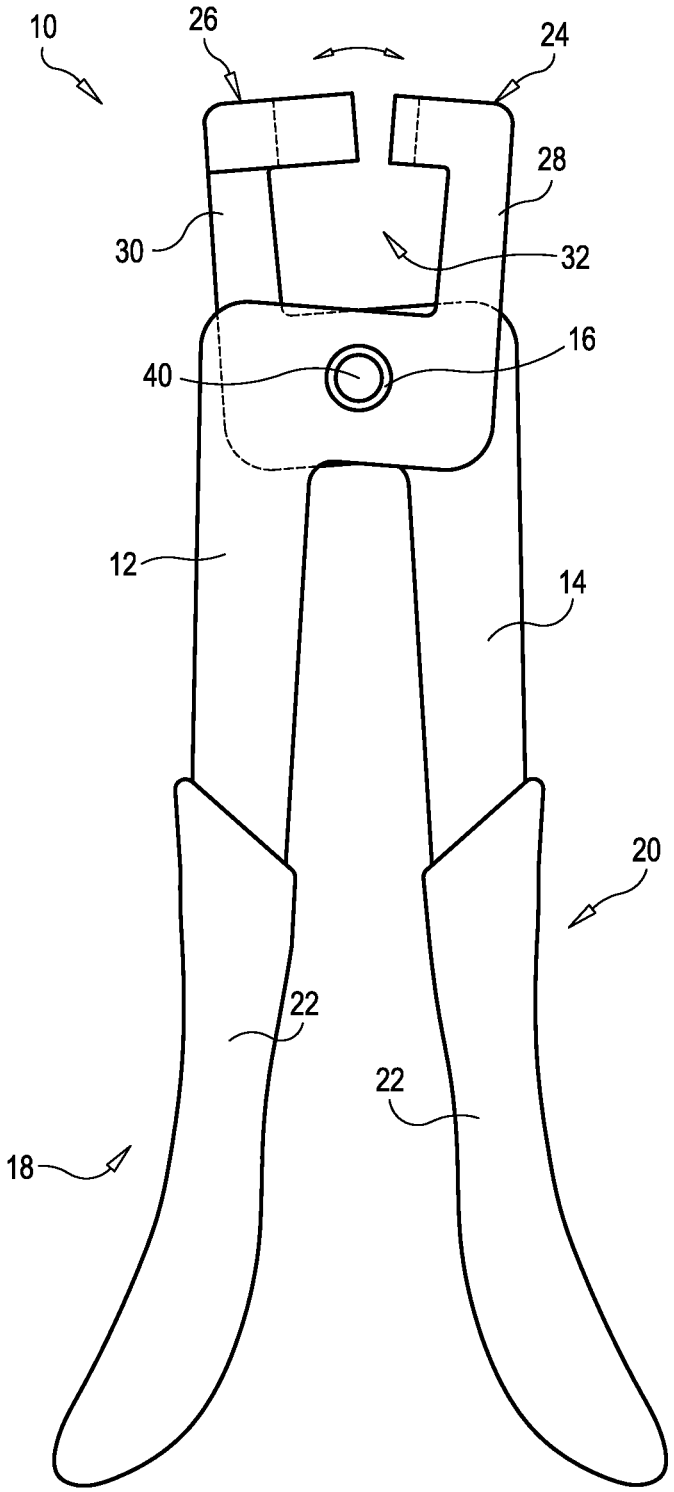
FIG. 1 is a side view of an electrical connector crimping plier tool in accordance with an embodiment of invention.

FIG. 1 representatively illustrates an electrical connector crimping plier tool 10 according to an embodiment of the invention. Tool 10 is particularly useful in crimping electrical connectors to ends of the electrical leads in tight spaces, such as, for example within the tight confines of a vehicle dashboard or engine compartment. Unlike crimping tools heretofore which require orientating the tool to position an electrical connector in direction across the tool, e.g. parallel to the pivot axis of the interconnected handles of the tool, tool 10 is constructed and arranged to position the electrical connector parallel with the tool, e.g. perpendicular to the pivot axis of the handles. To this end, tool 10 can be inserted into a tight confine to crimp electrical connectors to electrical leads.

The tool 10 includes handles 12 and 14 that are pivotally joined together by a pivotal coupling 16 for rotation towards and way from one another about a rotation axis 40 that extends through the pivot coupling and generally perpendicular to the handles. Handles 12 and 14 are constructed from a suitable hard material, such as, but not limited to tool steel. Handles 12 and 14 include hand-gripping portions 18 and 20, respectively, which are grasped by a user to rotate the handles about the pivotal coupling 16. Gripping portions 18 and 20 may be covered by a suitable cushioning and/or anti-slip material 22 to provide comfort to the user's hands and/or to prevent the handles from slipping from the hands of user the during use.

A male crimping die 24 is formed on handle 12 at end 28 opposite of grip portion 18 and extends in an inwardly direction from end 28. A female crimping die 26 having a shape that is complementary to the male crimping die is formed on handle 14 at end 30 opposite of grip portion 20 and extends in an inwardly direction towards the male crimping die 24 from end 30. The rotation of handles 12 and 14 results in dies 24 and 26 being moved towards and away from one another between engaging and non-engaging positions.

Male crimping die 24, end 28, female crimping die 26 and end 30 collectively define an opening 32. As will explained below, opening 32 provides a clearance into which an electrical connector and/or electrical lead may be positioned without impeding the operation of the tool and such that the electrical connector and/or electrical lead is not damaged by being pinched between handles 12 and 14 during a crimping operation, wherein the handles are rotated towards each other and into a close relative position.

Figure 2:
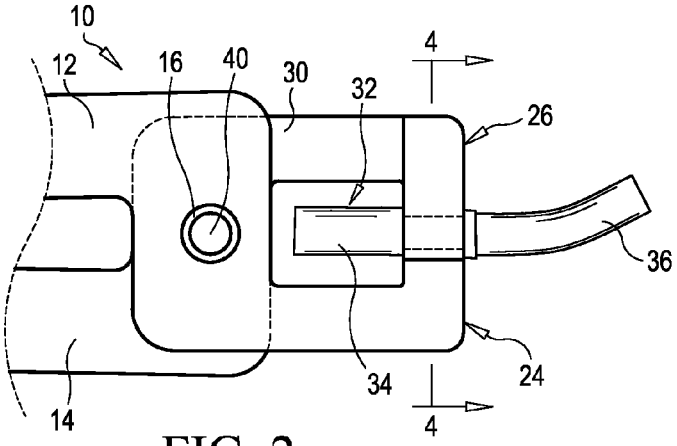
FIG. 2 is a side view of an electrical connector crimping plier tool in accordance with an embodiment of the invention view showing the tool in use in a first configuration.

In FIG. 2 there is, representatively illustrated, an embodiment of tool 10 in-use and crimping an electrical connector 34 to electrical lead 36. As illustrated herein, electrical connector 34 is positioned between crimping dies 24 and 26 with the electrical lead 36 extending into an externally face end portion of the electric connector. The remaining portion of the electrical connector 34 extends inwardly into opening 32 from the crimping dies 24 and 26. To this end, a user applying opposite and inwardly directed force on handles 12 and 14 urges the crimping dies 24 and 26 towards one another, wherein the electrical connector 34 is crimped and secured to electrical lead 36. It is of particular importance to note the electrical connector 34 is safely disposed within opening 32 and is not pinched between handles 12 and 14.

Figure 3:
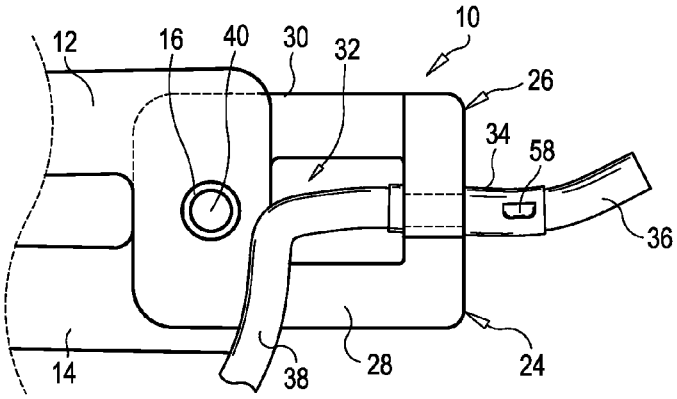
FIG. 3 is a side view of an electrical connector crimping plier tool in accordance with an embodiment of the invention view showing the tool in use in a second configuration.

In FIG. 3 there is representatively illustrated an embodiment of tool 10 in-use and crimping electrical connector 34 to a second electrical lead 38 to splice electrical lead 36 and 38 together. As illustrated herein, the electrical connector 34 is once again positioned between crimping dies 24 and 26 with electrical lead 38 extending through opening 32 and into an internally face end portion of the electrical connector. A user applying opposite and inwardly directed force on handles 12 and 14 urges the crimping dies 24 and 26 towards one another, wherein the electrical connector 34 is crimped and secured to electrical lead 38. Again it is of particular importance to note the electrical connector 34 and electrical lead 38 is safely disposed within opening 32 and is not pinched between handles 12 and 14. Further shown is crimp 58 previously formed and joining electrical connector 34 and electrical lead 36.

While the above description of tool 10 pertains to the crimping of an electrical lead splicing connector or butt-type connector, tool 10 may be utilized in the crimping of other forms of electrical connectors to electrical leads, and is not limited only to butt-type connectors.

Figure 4:
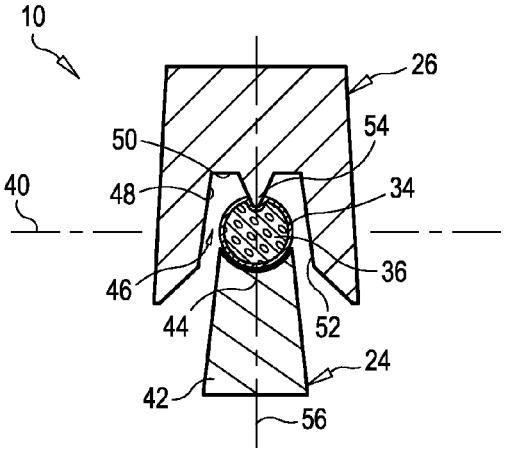
FIG. 4 is an end cross-sectional view taken along line 4-4 in FIG. 2 illustrating crimping dies according to an embodiment of the invention.

In FIG. 4, there is representatively illustrated a cross-sectional view taken along line 4-4 in FIG. 2 and through crimping dies 24 and 26. A key aspect of embodiments of the invention lays in the orientation of crimping dies 24 and 26 relative to handles 12 and 14 and axis 40 about which the handles are rotated. Specifically and as clearly illustrated here in FIG. 4, crimping dies 24 and 26 are arranged such that an electrical connector 34 is received between the crimping dies in a position that orientates the electrical connector 34 generally perpendicular to axis 40. To this end, the electrical connector is inserted between crimping dies 24 and 26 in an endwise direction (a direction perpendicular to axis 40) from a position exteriorly of the crimping dies. Whereas in prior crimping tools, the electrical connector is positioned between crimping dies in a position that orientates the electrical connector generally parallel to the rotational axis of the handles, and further, the electrical connector is inserted between the crimping dies in a sidewise direction (a direction parallel to the rotational axis).

As best seen in FIG. 4, and in an embodiment of tool 10, male crimping die 24 includes a leg portion 42 that terminates at an inward, inwardly curved end 44. End 44 is curved to generally conform to the curvature of the electrical connector 34 and serves to cradle the connector during crimping. Female crimping die 26 includes a generally U-shaped and inwardly opening space 46 that is defined by two side wall portions 48 and 52, and an upper wall portion 50, into which the male crimping die 24 is removably disposed. A projection 54 is formed on the upper wall portion 50 and extends therefrom into space 46 where it terminates. Projection 54 tapers from wide to narrow in a direction from the upper wall portion 50 towards the terminal end thereof. Projection 54 and end 44 are oppositely disposed and positioned along center-line 56. Projection 54 serves to crimp the electrical connector 34 as crimping dies 24 and 26 are urged together while end 44 serves to cradle and align the electrical connector along center-line 56.

It can now be fully understood the advantages provided by embodiments of tool 10 in permitting the crimping of electrical connectors to electrical leads in tight confines. For example, electrical leads located in engine compartments and instruments panels of vehicles are typically disposed within a narrow space between adjacent structures. More often than not, the electrical leads are too short to extend to a position outwardly from the narrow space making access difficult and making the crimping of an electrical connector to the electrical lead even more difficult. Often it becomes a juggling act of positioning the electrical connector on the electrical lead and positioning the crimping tool in an awkward and twisted position in an attempt to at least partially position the electrical connector, while attached to the electrical lead, between the crimping dies. Because of this, it may require several attempts to crimp the electrical connector to the electrical lead and may result in tossing electrical connectors because of failed crimps.

Crimping tool 10 eliminates these problems as the tool can simply be inserted straight into the narrow space to position the electrical connector between crimping dies 24 and 26 in an endwise direction, rather than a sidewise direction. Moreover, crimping tool 10 can be used to hold the electrical connector for positioning on the electrical lead as a result of the specific configuration of crimping dies 24 and 26. Specifically, an electrical connector may be position within space 46 of crimping die 24 and held therein by crimping die 26 by exerting a slight, yet sufficiently strong force on handles 12 and 14 to grip the electrical connector between the crimping dies. A sufficiently strong force is a force that is high enough to prevent sliding of the electrical connector between the crimping dies 24 and 26, but not enough to cause a crimping action between the dies that would result in projection 54 crimping the electrical connector.

A number of embodiments of the present invention have been described. Nevertheless, it will be understood that various modifications may be made without departing from the spirit and scope of the invention. Accordingly, other embodiments are within the scope of the following claims.

What is claimed is:

1. A plier tool for crimping electrical connectors to wires, the tool comprising:

first and second plier handles pivotally connected together by a pivotal coupling for rotation towards and away from one another about an axis of rotation extending through said pivotal coupling and generally perpendicular to said first and said second plier handles, each of said first and second plier handles having gripping portions that are graspable by a user to rotate said first and said second plier handles about said axis of rotation;

a male crimping die on said first plier handle at an end opposite of said gripping portion thereof;

a female crimping die on said second plier handle at an end opposite of said gripping portion thereof, wherein rotation of said first and said second plier handles cause said male crimping die and said female crimping die to be moved towards and away from one another between engaging and non-engaging positions;

said male crimping die and said female crimping die together defining an opening configured to receive an electrical connector therein in an orientation that positions the electrical connector in an endwise direction that is generally perpendicular to said axis of rotation; and wherein said male crimping die includes a leg portion having a concaved end configured to cradle the side of an electrical connector; and said female crimping die is generally U-shaped and includes a projection extending from a wall opposite of said concaved end.

2. The plier tool according to claim 1, wherein said concaved end and said projection are oppositely disposed along a center line, and wherein said concaved end serves to align the electrical connector along said center line.

3. The plier tool according to claim 2, wherein said female crimping die includes generally two side wall portions and an upper wall portion that define said U-shape of said female die, and wherein said projection is disposed on said upper wall portion.

4. The plier tool according to claim 3, wherein said projection tapers from wide to narrow in a direction from said upper wall portion toward the terminal end thereof in said generally U-shaped inwardly opening space.

5. The plier tool according to claim 4, wherein said gripping portions are covered by a cushion material to provide comfort to the hands of the user during use.

6. The plier tool according to claim 5, wherein said cushion material is also an anti-slip material to prevent said first and said second plier handles from slipping from the user's hands during use.

* * * * *